United States Patent [19]

Barraco et al.

[11] 4,268,775

[45] May 19, 1981

[54] CATHODE-HEATER ASSEMBLY AND SUPPORT STRUCTURE THEREFOR

[75] Inventors: Anthony J. Barraco, 2300 - E Zanker, San Jose, Calif. 95131; Albert M. Rockwell, Belmont, Calif.

[73] Assignee: Anthony J. Barraco, San Jose, Calif.

[21] Appl. No.: 885,636

[22] Filed: Mar. 13, 1978

[51] Int. Cl.[2] ..... H01J 1/20; H01J 19/14

[52] U.S. Cl. ..... 313/337; 313/250; 313/287; 313/340; 313/446

[58] Field of Search ..... 313/337, 250, 340, 287, 313/265, 268, 444, 446

[56] References Cited

U.S. PATENT DOCUMENTS

| | | | |
|---|---|---|---|
| 2,899,590 | 8/1959 | Sorg et al. | 313/268 X |
| 3,155,865 | 11/1964 | Ney | 313/446 X |
| 3,222,561 | 12/1965 | Reinhardt | 313/340 X |
| 3,445,712 | 5/1969 | Stuart | 313/250 |
| 3,803,441 | 4/1974 | Ohsawa et al. | 313/340 |
| 3,906,276 | 9/1975 | Barraco et al. | 313/337 |

*Primary Examiner*—Saxfield Chatmon, Jr.
*Attorney, Agent, or Firm*—John J. Leavitt

[57] ABSTRACT

Presented is a cathode-heater assembly including a support structure for the cathode-heater assembly that is particularly rugged in that it resists displacement of the cathode-heater assembly in all planes, and minimizes power requirements to raise the cathode to operating temperature.

36 Claims, 11 Drawing Figures

CATHODE-HEATER ASSEMBLY AND SUPPORT STRUCTURE THEREFOR

BACKGROUND OF THE INVENTION

1. Field of the Invention

This invention relates to cathodes, and particularly to cathode-heater assemblies and a rugged vibration resistive support structure therefor.

2. Description of the Prior Art

The prior art related to this invention is believed found in Class 313, sub-classes 271 and 337 and includes United States patents cited in prior U.S. Pat. Nos. 3,906,276 and 3,914,639.

It is one of the important objects of the present invention to provide a cathode-heater assembly in which the cathode is supported directly by the heater.

It is another object of the present invention to provide a cathode-heater assembly associated with a mounting or support structure therefor that requires significantly lower power than conventional cathode-heater assemblies to achieve satisfactory electron emission levels.

Another object of the invention is the provision of a cathode-heater assembly that utilizes a mounting structure that resists displacement of the cathode-heater assembly in all directions.

Cathode-heater assemblies of conventional types have been deficient in that considerable power is required to bring the cathode temperature to an electron emissive level. Conventional cathode assemblies utilizing, for instance, a $\frac{1}{8}''$ diameter cathode such as used in a cathode ray tube (CRT) require approximately thirty seconds to achieve satisfactory operating temperature. Accordingly, it is another object of this invention to provide a cathode-heater assembly that achieves satisfactory operating temperature in from seven to ten seconds.

It is well known that conventional CRT cathodes of approximately $\frac{1}{8}''$ diameter having an oxide emissive layer require power at a level of about 50 watts per square centimeter to raise the temperature of the cathode to about 850° C., this temperature providing a satisfactory level of electron emission. Accordingly, a still further object of the invention is to provide a cathode-heater assembly including a support structure therefor that requires a power level of only approximately 10 watts per square centimeter to bring the cathode to satisfactory electron emission temperature.

Indirectly heated cathodes are conventionally supported by a sleeve attached to the underside of the cathode button or to its cylindrical periphery, or the cathode is formed as the bottom part of a cup-shaped structure which tends to form a heat sink, thus drawing heat from the cathode button and therefore requiring the input of additional energy to compensate for the heat lost by conduction through the support structure. Accordingly, it is a still further object of the present invention to provide a cathode support structure which minimizes the loss of heat by conduction through the support structure.

In conventional cathode-heater assemblies, it is not unusual for the heater to operate approximately 400° C. higher than the cathode temperature to compensate for the heat lost through conduction through the structure by which the cathode button is supported. It is therefore an object of the present invention to provide a cathode-heater assembly in which the differential of temperature between the cathode button and the heater is minimized to the point where these two temperatures are approximately the same.

One of the well known deficiencies of CRT cathodes is that the heater operates at a much greater temperature than the cathode. The heater is thus short-lived, prematurely destroying the entire assembly. Accordingly, it is a still further object of this invention to greatly increase the expected life of a cathode-heater assembly by providing a cooperative relationship between cathode and heater in which there is not such a great disparity in temperature between the heater and cathode.

Structurally, conventional CRT cathodes, whether of the dispenser type or of the oxide type, have been susceptible to impact shocks and vibration when used in environments in which such conditions are inherent. Such environments include weaponry and satellites and a host of other environments in which high impact shocks and vibration are present. In some instances, the structural arrangement between the cathode-heater assembly and the supporting structure for such assembly has not been designed to withstand such vibration, with the result that such assemblies are short lived. On the other hand, preferably ruggedized assemblies have had the disadvantage of conducting heat away from the cathode, thus requiring high power input. Accordingly, a still further object of the present invention is to provide a cathode-heater assembly supported in such a way that displacement in all directions is resisted by the structure so as to maintain the cathode in a fixed position, while the support structure functions as a heat dam rather than a heat sink, thus also reducing power requirements while increasing ruggedness.

Cathode-heater assemblies of conventional design are usually designed in a cylindrical configuration because in most instances the cathode button itself is circular. Such design configuration requires complex manufacturing techniques. We have found that a planar configuration is more expeditious from a manufacturing point of view, thus reducing the manufacturing cost for a given cathode-heater assembly and therefore making the cathode-heater assembly available at a more competitive price to a greater portion of the market. Accordingly, still another object of the invention is to provide a support structure for a cathode-heater assembly that is fabricated with reference to a planar configuration rather than a cylindrical configuration and which is susceptible to mass production techniques.

One of the difficulties encountered in the manufacture of a conventional cathode-heater assembly is the accurate placement of the cathode in relation to its supporting structure and in relation to the heater. Highly sopisticated equipment to achieve such placement has been required. Further, because of the small size of the units in question, each of the cathode buttons usually has to be individually handled and appropriately spot-welded to its supporting structure, which is usually independent of the heater and its support structure. Accordingly, a still further object is the provision of a cathode-heater assembly that constitutes a composite unit supported on integrally associated support structure common to both the cathode and the heater.

In conventional cathode-heater assemblies it sometimes happens that diode current emission occurs between the cathode and associated structure because of the close spacings required in extremely small assemblies. One of the objects of the present invention is to provide a cathode-heater assembly in which shield means are provided to eliminate, or reduce to an acceptable level, any such diode current emission.

It is well known by those skilled in the art that in many applications it is only a relatively small central area of a cathode that is the effective source of electrons. In many instances, merely to facilitate handling, the cathode button is much larger in diameter than the effective central emissive area of the cathode, thus increasing the mass of the cathode beyond what is needed for emissive purposes. Such excessive mass requires the input of greater heater power than would be required if the diameter of the cathode and therefore the mass could be reduced to approximately the effective diameter of the emissive area. Accordingly, it is still another object of the invention to provide a cathode-heater and support structure therefor that facilitates reduction of the cathode button diameter.

The invention possesses other objects and features of advantage, some of which, with the foregoing will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the cathode-heater assembly and support structure therefor of this invention comprises a modular construction of cathode-heater for use in thermionic discharge devices having an indirectly heated cathode and which utilizes the heater leads to support the cathode to thereby minimize thermal loss from the cathode through the support structure. Additionally, the heater package is modular in the sense that it is fabricated as a composite unit and secured to the cathode in close abutting relationship to increase the conduction of heat from the heater package into the juxtaposed cathode button. To prevent undesirable movement of the cathode-heater assembly, support means are provided for the cathode-heater assembly that resists displacement of the assembly in all directions. Means are also provided in the structure for shielding portions of the heater structure, particularly the heater leads, from diode current emission. Means are also provided forming part of the cathode-heater support assembly for supporting the entire unit in an associated utilization structure such as a cathode ray tube.

DESCRIPTION OF THE PREFERRED EMBODIMENT

Figure 1:
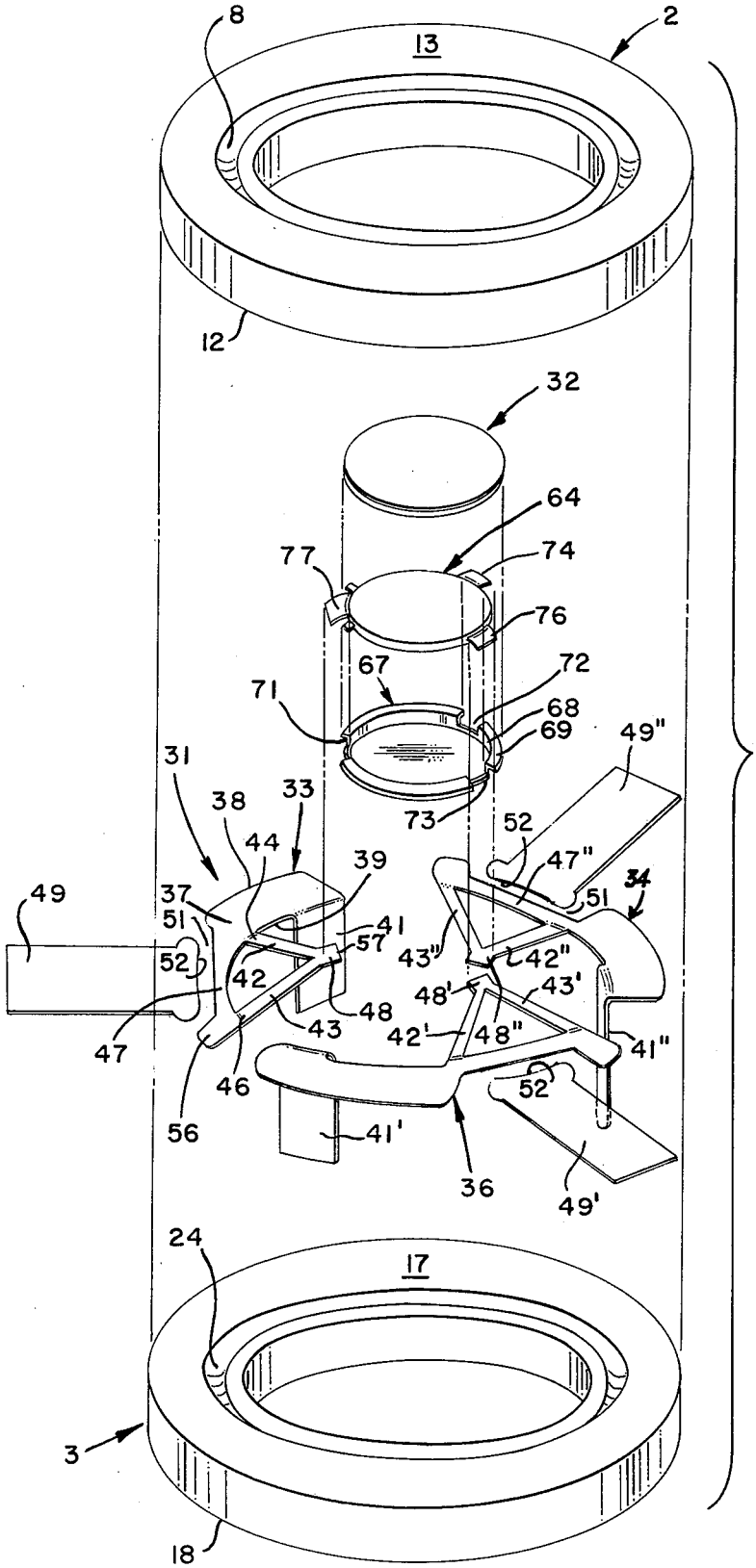
FIG. 1 is a perspective view in exploded form illustrating the relationship of the various parts of the cathode-heater assembly and support structure therefor.

In terms of greater detail, the cathode-heater assembly and support structure therefor is fabricated in a modular configuration to facilitate mass production. The support structure includes a pair of dielectric support rings 2 and 3, each of the rings being toroidal in configuration, with the ring 2 having an outer peripheral body portion 4 integrally joined by an inner peripheral shield portion 6, the inner peripheral portion having an inner periphery 7. The transverse thickness of the inner peripheral portion is somewhat less than the thickness of the outer peripheral portion 4. Disposed between the inner and outer peripheral portions 4 and 6 of the ring 2 are a pair of opposed annular grooves 8 and 9 which function for a purpose which will hereinafter be explained. The ring 2 is also provided with a bottom surface 12 and a top surface 13 which lie in parallelism.

The second ring 3 is also provided with an outer peripheral portion 16 having an upper surface 17 and a lower surface 18 in parallelism with each other, and an inner peripheral portion 19 having an inner peripheral surface 21. The inner peripheral portion 19 is joined integrally to the outer peripheral body portion 16 by a reduced in thickness neck portion 22 defined by a pair of oppositely disposed annular grooves 23 and 24. As with the dielectric ring 2, the thickness of the inner peripheral portion of the ring 3 is less than the thickness of the outer peripheral body portion so that when the two rings are placed end-to-end, i.e., with the bottom surface 12 of ring 2 contiguous with the top surface 17 of the bottom ring 3, a shield space 26 is provided between the adjacent surfaces of the inner peripheral portions 6 and 19.

Figure 3:
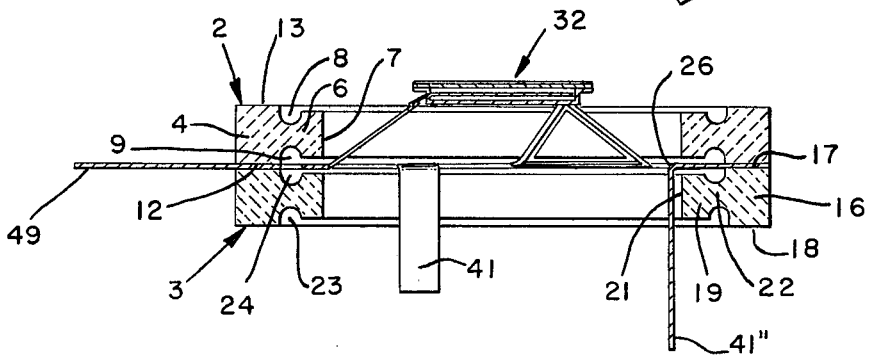
FIG. 3 is a vertical cross-sectional view taken in the plane indicated by the line 3—3 in FIG. 2.
Figure 4:
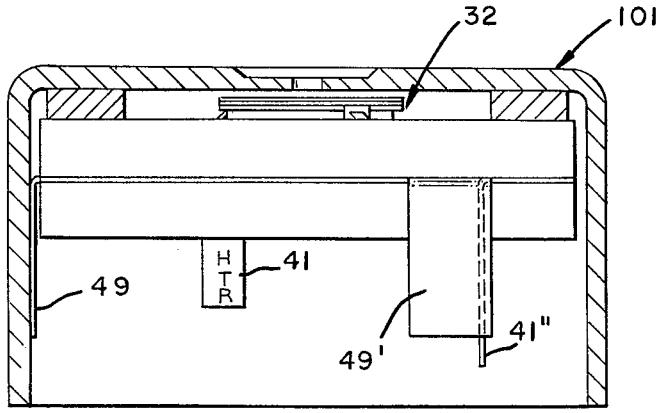
FIG. 4 is a vertical cross-sectional view showing the cathode-heater assembly, including the support structure therefor, supported within associated structure of a CRT.

Disposed between the two juxtaposed dielectric rings 2 and 3 which, as viewed in FIG. 3, are axially aligned and arranged in end-to-end relationship, is a support structure including electrically conductive terminal means, the support structure assembly being designated generally by the numeral 31 as illustrated in FIG. 1, and constituting a rigid support for the cathode-heater assembly designated generally by the numeral 32.

Figure 2:
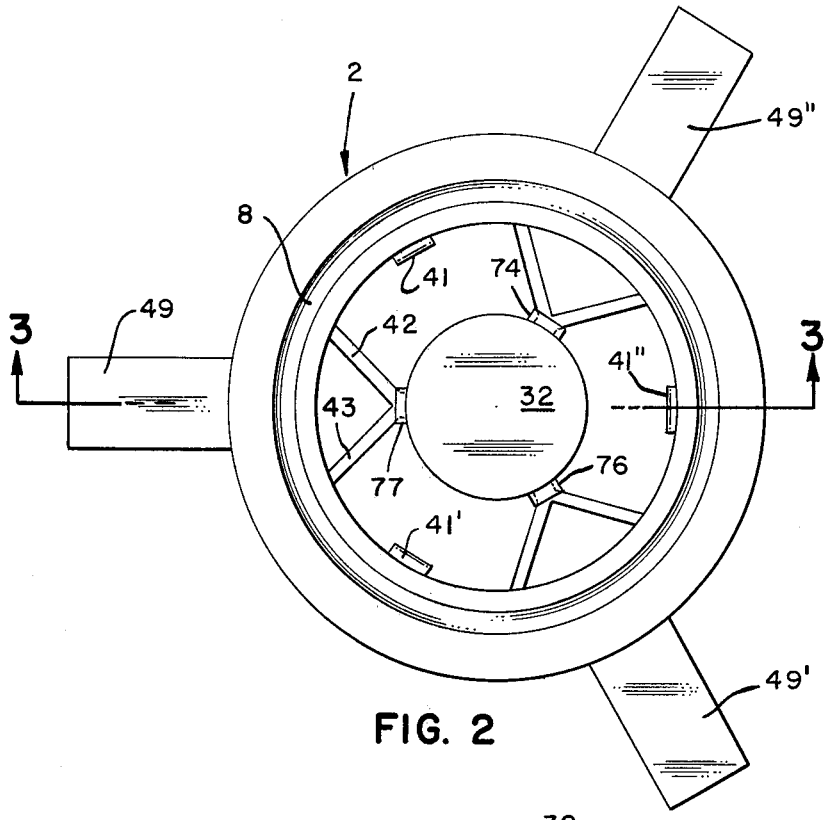
FIG. 2 is a plan view of the cathode-heater assembly including the support structure in assembled form.

Referring to FIGS. 1, 2, 3 and 5, it will be seen that the support structure or assembly designated generally by the numeral 31 comprises three independent electrically conductive means anchored between the rings 2 and 3 and including support units 33, 34 and 36, each support unit comprising a main arcuate body portion 37 lying in a plane common to the body portions of the other support units, and including an outer periphery 38 and an inner periphery 39. Integral with and extending from one end of the arcuate body portion 37 generally perpendicularly to the plane of the associated body portion is a terminal strap 41. Integrally formed on the opposite end of each arcuate body portion 37, is a triangled support structure that is approximately equilateral in its configuration, as shown in FIGS. 2 and 3, and comprising a pair of support members 42 and 43, the lower end base portions 44 and 46, respectively, being integral with an extension 47 of the arcuate body portion and constituting the base or third member of the triangled approximately equilateral support structure. The two support members 42 and 43 are spaced apart at their base ends 44 and 46 and converge toward each other to be integrally connected at their apex ends in a support tab 48. It should be noted that these triangled support structures are inclined upwardly as viewed in FIG. 1, so that while the base member 47 lies in the plane of the associated body portion the two remaining members 42 and 43 and the tab 48 lie above the plane thereof and inclined thereto. Also forming part of the assembly is a radially outwardly extending support strap 49 having its inner end caught between the dielectric rings 2 and 3.

As indicated above, the support means anchored between the rings includes three such support units 33, 34 and 36 arranged in a circular array, each of the support units 33, 34 and 36 being substantially identical with the exception of the radially inwardly extending terminal strap formed on support unit 34 which has a rounded end rather than a square end for ease in identifying this specific terminal strap in the array. In the interest of brevity in this description, the same reference numbers with primes applied have been utilized to designate similar structure in the three support units. The three support units 33, 34 and 36 are fabricated from an appropriate material such as Hastaloy-B, which comprises a Molybdenum-Nickel alloy, having a thickness of approximately 0.002".

As illustrated in FIG. 3, the radially inwardly projecting terminal straps or fingers 41, 41' and 41" are arranged to project downwardly, while the triatic support arms 42–43, 42'–43' and 42"–43" project radially inwardly and upwardly as shown so that the terminal straps or fingers are circumferentially spaced about the central axis of the array at intervals of approximately 120° and extend substantially perpendicular to the plane of the body portion from which they project. The support arms 42–43 of each support unit project in the opposite direction out of the plane of the associated base and body portion so that they form an angle of approximately 40°. The upper apex ends terminate in tabs 48 arranged in a circular array about the central axis thereof and spaced at 120° intervals. It will thus be seen that each of the support arm structures 42–43 individually forms an integral triangled structure having its base end formed by the integral extension 47 of the body portion 37 and arms joined integrally at their apex ends in the tab 48, thus constituting a very rigid structure resistant to transverse or circular displacement. For purposes which will hereinafter be explained, the base extension 47 at its end remote from the arcuate body portion 37 is provided with an integral radially extending anchor member or tab 56.

To join the three support structures 33, 34 and 36 into a composite assembly there is bonded to opposite sides of the planar arranged arcuate body portions 37 and extensions 56, a pair of toroidal dielectric members 2 and 3 formed preferably from aluminum oxide. As illustrated in FIGS. 1, 2 and 3, the dielectric members are co-axially aligned with the support units 31. The terminal straps or fingers 41 project downwardly as viewed in FIG. 3 so that they project in front of and spaced from the inner peripheral surface 21 of dielectric ring 3, while the triangled support structures 42–43 project inwardly and upwardly from adjacent their bases which lie close adjacent the inner periphery of the dielectric rings. The support structures project past the inner peripheral face 7 of ring member 2. Preferably, the length of the support arm structures 42–43, and placement of the integral connecting tab 48 are gauged so that the upper end edge 57 of each of the tabs 48 lies substantially flush with or in a plane coincident with the top surface 13 of dielectric ring 2.

With the triangled support structure thus formed, it will be seen that each of the radially extending support straps 49 associated with but electrically isolated from each of the support structures by the space 51 projects radially outwardly beyond the outer periphery of the ring assembly 2–3 at circumferential intervals of approximately 120°. It should also be noted that the inner end portions 52 of the support straps 49, where these inner end portions are associated with but spaced and electrically isolated from the arcuate body extension or base member 47, are embedded or sandwiched between the oppositely facing surfaces of the outer peripheral body portions 4 and 16 (FIG. 3) of dielectric rings 2 and 3, thus anchoring each of the radially outwardly extending support straps 49 securely to the ring assembly. In this connection it should be understood that the two opposed ring surfaces 12 and 17 are bonded together using glass frit technology.

Additionally, it should be noted that the arcuate body portion 37 of each of the support units 33, 34 and 36 is likewise sandwiched between the surfaces 12 and 17 of the dielectric rings to thus similarly anchor between the ring assembly each of the depending terminal straps 41 of each support structure 33, 34 and 36. To further insure stability of the structure, the radially extending anchor portion or tab 56 of each support unit is in like manner embedded or sandwiched between opposing surfaces 12 and 17 of the dielectric rings, thus insuring that each of the support structures 33, 34 and 36 forms a substantially immovable support base in relation to the ring assembly.

In the operation of thermionic tubes it is frequently found that vaporized material from the cathode migrates to and condenses on various surfaces within the tube, thus providing undesirable electrically conductive paths. To obviate this problem in this construction, it should be noted that the annular grooves 9 and 24 in rings 2 and 3, respectively, and the reduced in thickness inner peripheral portions 6 and 19 of rings 2 and 3, respectively, cooperate to provide a tortuous path which functions as an optical shield through which such migration of vaporized material may not penetrate. The arcuate body extension or base member 47 of each triangled support structure lies chord-like in the space between the opposed faces of the inner peripheral body portions 6 and 19 of rings 2 and 3, respectively, this web being positioned in non-contacting relation midway between the opposing surfaces of the inner peripheral portions 6 and 19 in the space 26 formed therebetween.

Even without interconnection of the three triatic support arm assemblies 42–43 it will be seen that each of the support arm assemblies is inherently stable by virtue of its triangular configuration, which provides integral interconnection of the arms 42 and 43 at their apex ends by the tabs 48 and by virtue of the fact that their base end portions 44 and 46 are integral with the extension or base member 47, which in turn is integral with members 37 and 56 securely anchored between the ceramic rings. If now the apex ends of the circularly arrayed support arm assemblies 42–43 are integrally interconnected by an appropriate rigid structure interposed therebetween, it will be noted that it converts the support arm assemblies into cooperating truss-like members that provide extreme rigidity and stability against displacement in all directions. In the embodiment illustrated in FIG. 3, the interconnection of the support arm pairs is effected by integrally joining each of the tabs 48 at the apex end of each support arm assembly to the cathode-heater assembly 32. The manner of this interconnection is seen in FIGS. 5 and 6–10.

Figure 5:
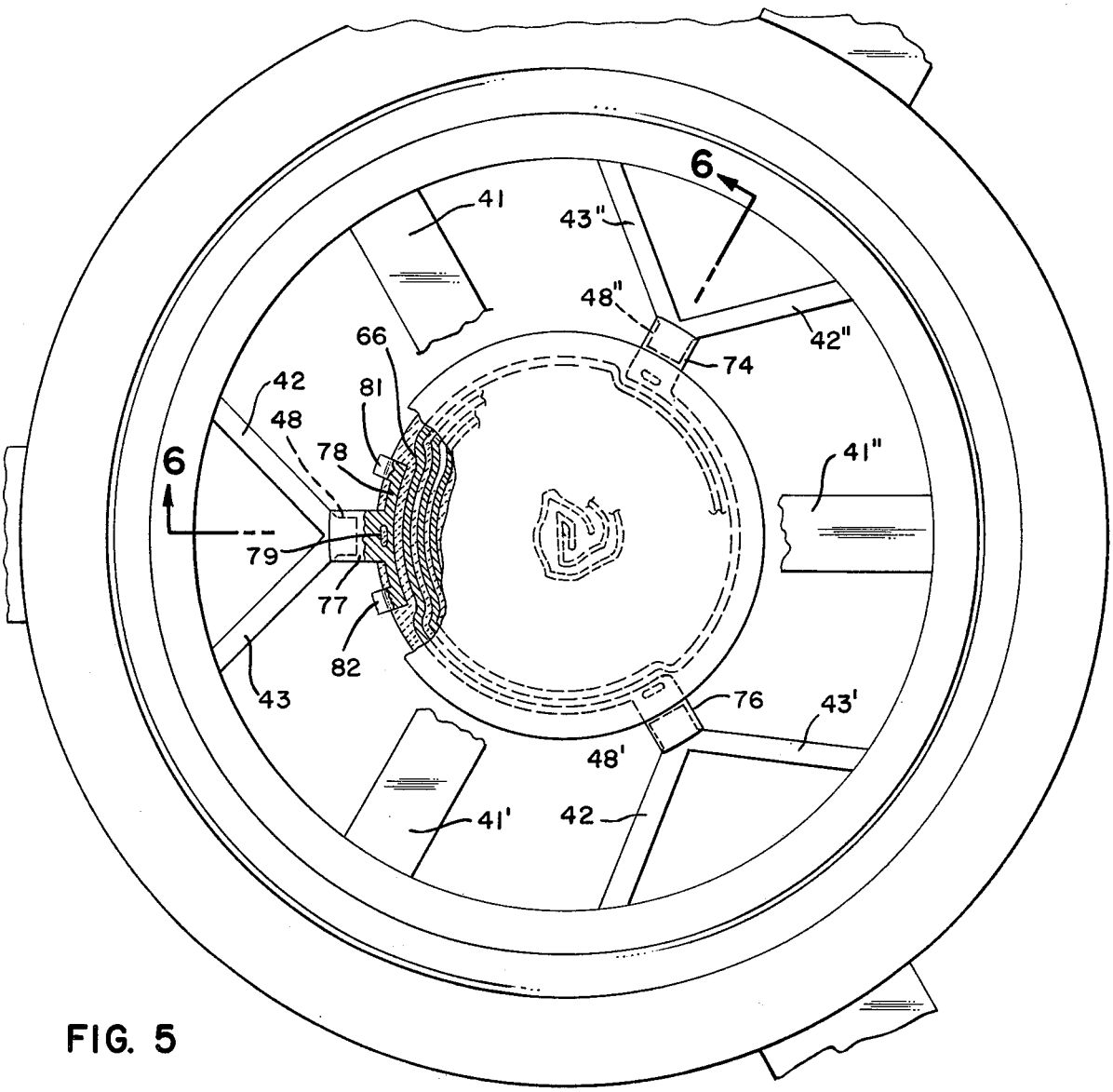
FIG. 5 is an enlarged plan view of the cathode-heater assembly, portions of the structure being broken away to reduce the size and to reveal underlying structure.
Figure 6:
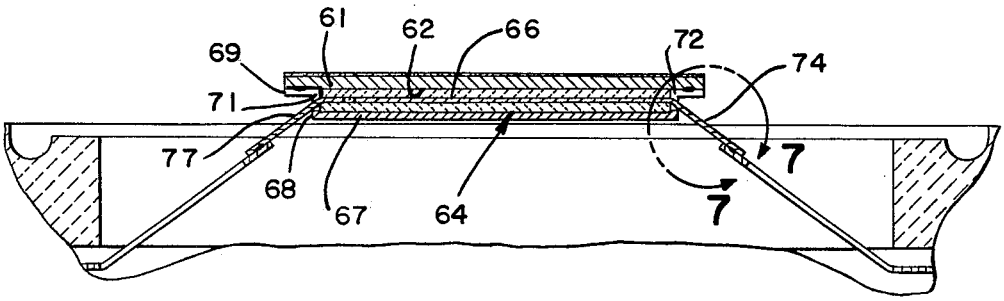
FIG. 6 is a fragmentary vertical cross-sectional view taken in the plane indicated by the line 6—6 in FIG. 5.
Figure 7:
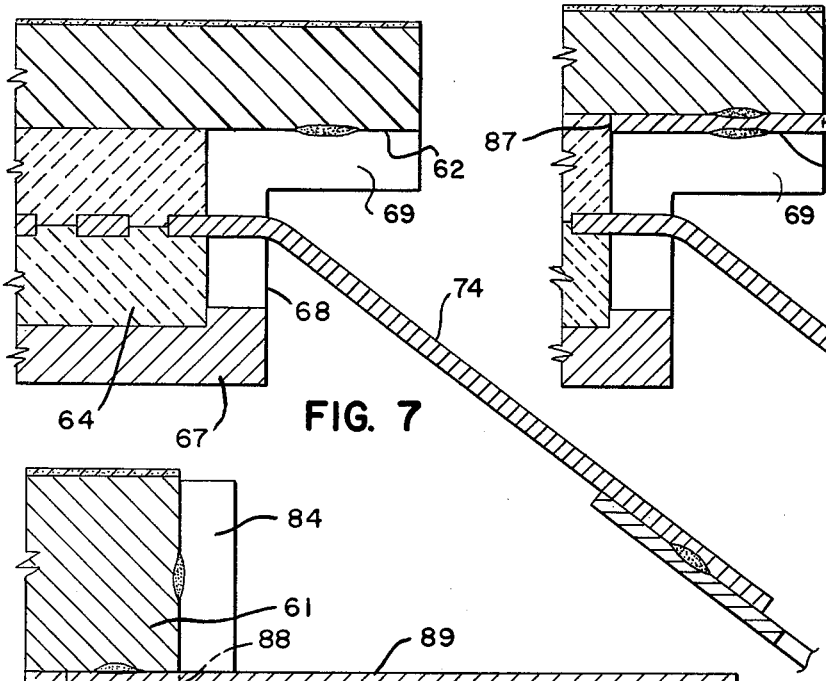
FIG. 7 is an enlarged fragmentary vertical cross-sectional view of the portion of structure encircled by the line 7—7 in FIG. 6.
Figure 9:
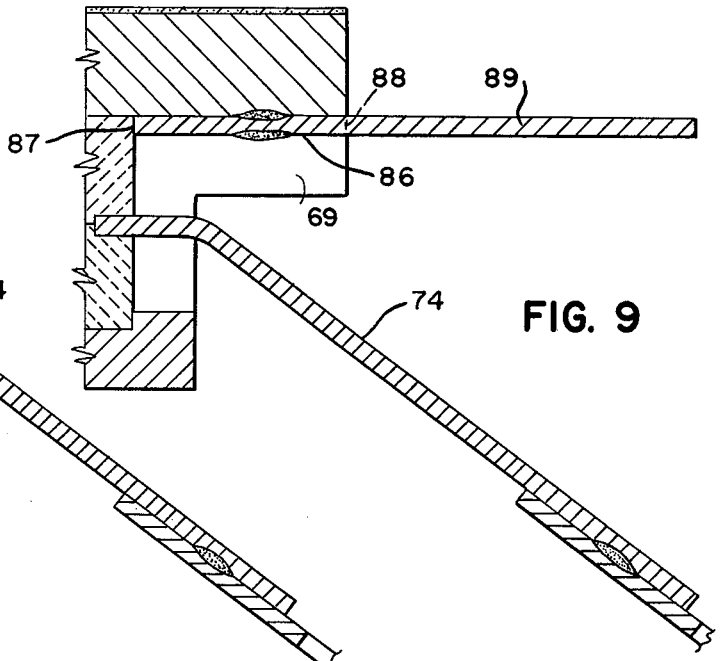
FIG. 9 is an enlarged fragmentary vertical cross-sectional view illustrating a diode current emission shield ring mounted on the cathode-heater assembly of the type shown in FIGS. 6 and 7.

Referring to FIGS. 5, 6 and 7, it will there be seen that the cathode-heater assembly comprises a cathode button 61 which may be in the order of 0.004" in thickness for an oxide-type cathode, or in the order of 0.015" to 0.025" if the cathode is a dispenser-type cathode, in either case having a diameter of approximately $\frac{1}{8}$" for many types of thermionic tubes. Disposed beneath the bottom surface 62 of the cathode button is a heater assembly designated generally by the numeral 63 and comprising a dielectric pellet 64 in which is embedded the heater element or filament 66 illustrated in FIG. 11. The cathode-heater assembly is enclosed by a thermally conductive shell 67 having a peripheral cylindrical wall 68 terminating in a radially extending flange 69 at the open end of the cup-shaped shell, the wall 68 and flange 69 being provided with slots 71, 72 and 73 spaced at intervals of 120°. The slots are provided to receive therethrough in an electrically insulated fashion heater leads 74 and 76 and support tab 77, the latter of which is electrically isolated from the heater filament, as illustrated in FIG. 5.

It will be seen that the heater leads 74 and 76 and the support tab 77 extend through the slots in non-contacting relation to the walls 68 of the can 67 and project radially outwardly and downwardly sufficiently to bring them into overlapping relationship in their end portions with the tabs 48 forming the upper apex ends of the triangled support arms 42–43. The overlapped portions are appropriately spot-welded as shown in FIGS. 6–9 to thus rigidly support both the cathode and heater on the now interconnected apex ends of the truss-like support finger assemblies 42–43, which in fact constitute the heater leads. It is noted that it is unusual and contra-indicated to support a cathode, especially in a thermionic tube, on the heater leads.

It should be understood that in order to make the cathode-heater assembly a rigid composite structure, the circular flange 69 is spot-welded to the lower surface 62 of the cathode button adjacent its outer peripheral portion. It should also be understood that in terms of relative size, the illustrations in the drawings exaggerate the thickness of many of the elements for purposes of clarity. For instance, satisfactory structures have been fabricated utilizing a cathode button having a thickness of from 0.004" to 0.020", wherein the dielectric pellet 64 in which the heater element 66 is embedded has a thickness of only approximately 0.0075". In a cathode-heater assembly of this size, the hat-shaped or cup-shaped enclosing member 67 is fabricated from material only 0.001" thick and performs two functions: namely, to intercept heat from the dielectric pellet 64 and conduct such heat to the peripheral portion of the cathode button, thus increasing the efficiency of the cathode-heater assembly by diminishing the amount of power required, and secondly, to retain the cathode button securely mounted on the heater assembly without need of any other support.

It will be noted that after application of the cathode-heater assembly to the upper apex ends of the support arms 42–43, the cathode-heater assembly lies spaced a short distance above the upper surface 13 of the ring 2. It should of course be understood that this relationship may be varied according to requirements of a specific application by varying the lengths of the arm 42–43, or varying the angle at which they lie in relation to a horizontal plane so as to facilitate accomodation of the structure in many different environments.

Figure 11:
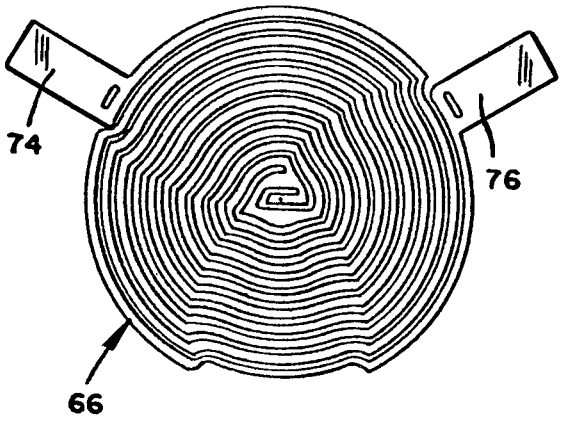
FIG. 11 is a plan view of the heater filament per se shown as an article of manufacture.

Referring in FIGS. 5 and 11 it will be noted that the heater filament 66 is formed in a modified spiral pattern with the terminal leads 74 and 76 connecting opposite ends of the filament. Thus, each of the heater terminal leads 74 an 76 are integrally and electrically conductively connected through support arms 42–43 with the respective heater terminal leads 41' and 41''. Note that the stability of the cathode-heater assembly is provided by support at three points at intervals of 120°, and that the support tab 77 is provided with an anchor portion 78 embedded in the dielectric pellet 64 adjacent one outer peripheral portion thereof and is provided with an aperture 79 to increase the anchoring effect of the tab with the dielectric pellet. A pair of electrically conductive tabs 81 and 82 project radially outwardly from the dielectric pellet. When the cathode can 67 is pressed around the pellet, the tabs 81 and 82 are bent upwardly so that they lie squeezed between the pellet and the inner periphery of the can 67, thus making electrical connection with the can and therefore to the cathode to provide a cathode connection through the tab 77.

Figure 8:
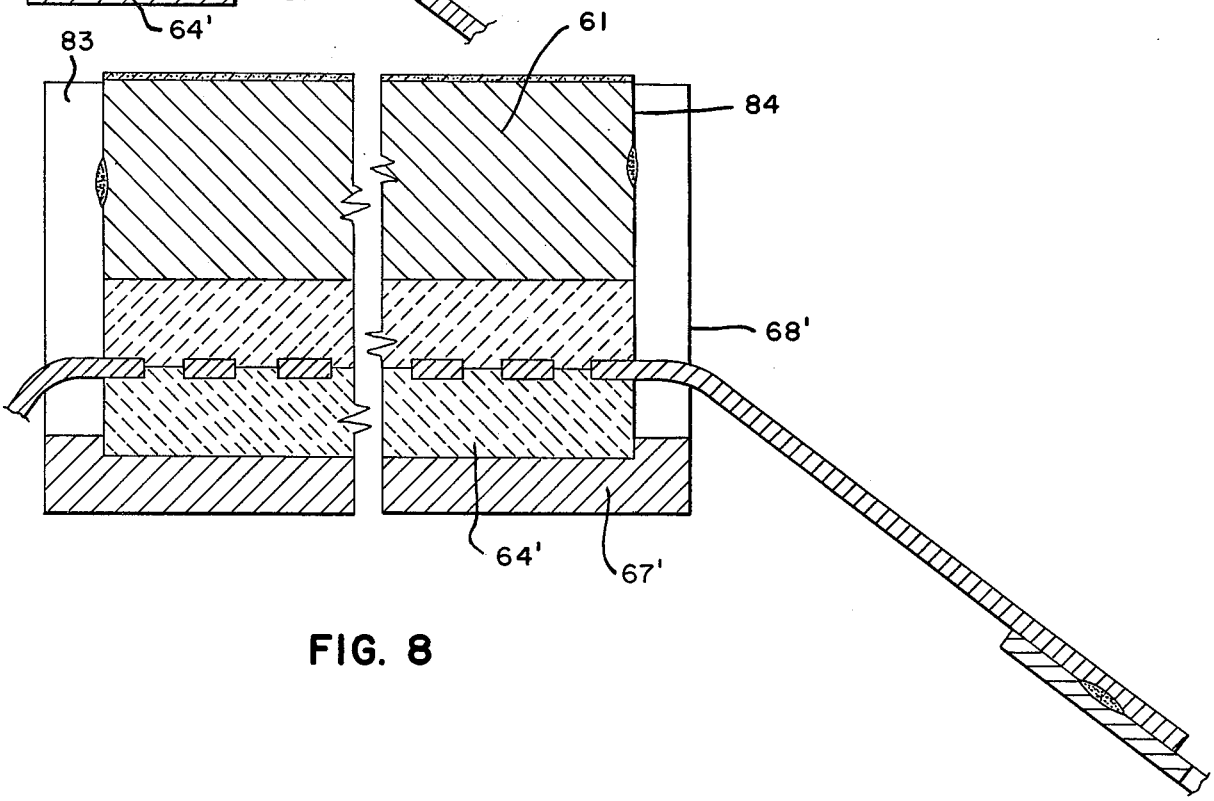
FIG. 8 is an enlarged fragmentary vertical cross-sectional view of the cathode-heater assembly embodied with a cathode having appreciable thickness.

Referring to FIG. 8, it will be seen that a different embodiment of the cup-shaped enclosure member 67 is depicted therein and designated 67'. The difference lies in the fact that the cylindrical wall 68' is cylindrical for its entire extent and is not provided with a radially projecting flange as in the embodiment illustrated in FIGS. 6 and 7. Rather, the upper cylindrical end portion 83 of the wall 68' closely surrounds the outer periphery 84 of the cathode button 61 and is appropriately spot-welded thereto so as to rigidly encase the periphery of the cathode and heater assembly in one composite unit. This embodiment has been found to be particularly advantageous in situations in which it is important to minimize the diameter of the cathode button to effect a reduction in the power input to the cathode. It is also very useful where the thickness of the cathode is substantial, in either dispenser or oxide type cathodes. Thus, inasmuch as the flange is omitted, the diameter of the cathode button may be reduced by at least twice the width of the flange 69. It should be understood that the cylindrical wall 68' is slotted in the same manner as discussed above for the cup-shaped enclosure 67 so as to permit electrically non-conductive projection therethrough of the heater terminal leads 74 and 76 and support tab 77, which functions as a cathode terminal and a mechanical support for the assembly.

As previously discussed, it is sometimes found that diode current emission occurs in thermionic tubes in which oppositely charged structural members are closely spaced. To preclude this phenomenon in the present structure, there is provided interposed between the bottom surface of the cathode in the embodiment illustrated in FIG. 9, an electron shield ring 86 having an inner periphery 87 coincident with the outer periphery of the heater package, or more specifically, coincident with the outer periphery of the dielectric pellet 64 and formed from thin sheet stock having a thickness in the order of 0.0005 inches. The outer periphery 88 of the shield is coincident with the outer peripheral edge of the cathode and the ring is provided with three radially outwardly projecting tabs 89 spaced at 120° intervals. By their projection beyond the periphery of the cathode button, the tabs, constituting electron shields, overlie the heater terminal leads 74 and 76 and support tab 77 to thereby shield these elements against diode current emission. We have found that it is not necessary to bend the tabs downwardly so that they lie parallel to the heater terminal leads to achieve such an electron shielding effect.

Figure 10:
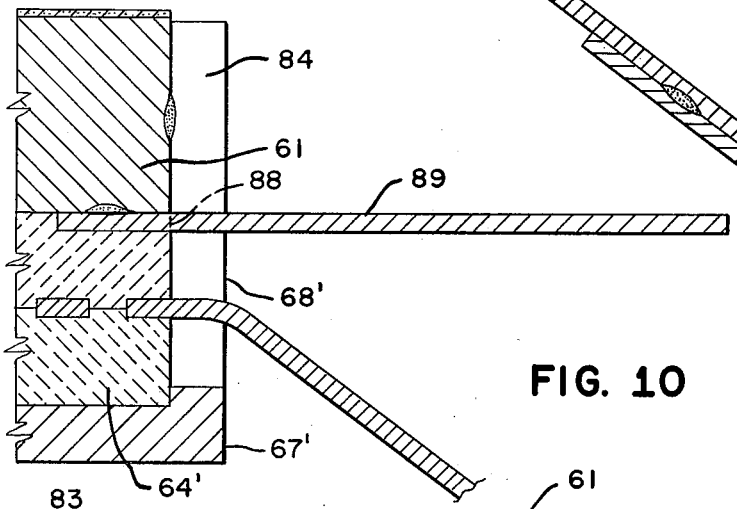
FIG. 10 is an enlarged fragmentary vertical cross-sectional view illustrating a diode current emission shield ring mounted on the cathode-heater assembly of the type shown in FIG. 8.

Referring to FIG. 10 which illustrates the embodiment of FIG. 8, the electron shield ring is shown applied to this embodiment in the same manner as in the embodiment illustrated in FIG. 7. In this case, the outer periphery 88 of the shield ring lies coincident with the outer periphery of the cathode as before while the remainder of the ring lies sandwiched between the upper surface of the ceramic pellet 64 and the underside of the cathode. Because of the extreme thinness of the shield and its minimal transverse cross-sectional dimension in the order of 0.004", no deleterious effect has been noted by such interposition. As before, the shield tabs 89 project radially outwardly through the slots 71, 72 and 73.

Referring to FIG. 11, the heater filament is formed from a single flat ribbon filament 66' and heater terminal leads 74 and 76. The extreme outer ends of the heater leads 74 and 76 (and support tab 77) are spaced at 120° intervals about the central axis, while the inner ends of the flat ribbon filament are electrically connected to provide a series connection between the heater leads 74 and 76.

Thus, once the construction illustrated in FIG. 11 has been completed, the heater filament 66 is ready to be embedded in the dielectric pellet 64. The heater filament 66 is placed or positioned coaxially in relation to dielectric pellets 64 on opposite sides thereof. Compression of the "green" dielectric pellets into a cohesive mass causes the dielectric material to flow into the interstices formed by the various coils of the heater filament, thus rigidly supporting the heater coils against displacement following firing of the dielectric material to effect sintering.

It will thus be seen that not only have we provided a cathode-heater assembly that is economical to manufacture and which is resistant to vibration and impact shocks, but we have provided a support structure that is inherently rigid and stable and which supports the cathode-heater assembly in an extremely stable condition resistant to displacement in any direction.

Having thus described the invention what is thought to be novel and sought to be protected by Letters Patent of the United States is as follows:

We claim:

1. In combination, a cathode-heater assembly and support structure therefor, comprising:

(a) a pair of dielectric mounting rings arranged in end-to-end relation and bonded to one another;

(b) means anchored between opposed ends of said mounting rings and including a plurality of approximately equilateral triangled support structures each having an apex end and a base end; and (c) a cathode-heater assembly having at least two electrically conductive radially outwardly extending heater leads, said assembly being fixed on the apex ends of said triangled support structures by means of said heater leads.

2. The combination according to claim 1, in which each said triangled support structure is triatic.

3. The combination according to claim 1, in which the base end of each said triangled support structure lies adjacent the inner periphery of said mounting rings.

4. The combination according to claim 1, in which the apex ends of said triangled support structures lie in a common plane spaced from the ends of said mounting rings bonded end-to-end.

5. The combination according to claim 1, in which the apex ends of said triangled support structures lie in a common plane substantially coincident with the end of one of said mounting rings remote from the end thereof bonded to the other ring.

6. The combination according to claim 1, in which the base ends of said triangled support structures lie in a first common plane and the apex ends of said triangled support structures lie in a second common plane spaced from and parallel to said first plane.

7. The combination according to claim 1, in which the base ends of said triangled support structures lie in a first common plan substantially coincident with a plane common to the ends of said mounting rings bonded end-to-end, and the apex ends of said triangled support structures lie in a second common plane spaced from and parallel to said first plane.

8. The combination according to claim 1, in which said means anchored between opposed ends of said mounting rings includes a plurality of electrically conductive terminal straps spaced circumferentially about the inner periphery of said mounting rings and extending substantially perpendicular to a plane common to the ends of said mounting rings bonded end-to-end.

9. The combination according to claim 1, in which said means anchored between opposed ends of said mounting rings includes a plurality of electrically conductive terminal straps spaced circumferentially from said triangled support structures.

10. The combination according to claim 1, in which the apex ends of said triangled support structures lie in a first common plane spaced on one side of a second plane common to the ends of said rings mounted end-to-end, and said means anchored between opposed ends of said mounting rings includes a plurality of electrically conductive terminal straps spaced circumferentially about the inner periphery of said mounting rings and extending from said second plane in a direction away from said apex ends.

11. The combination according to claim 1, in which each said triangled support structure comprises a pair of support members integral at corresponding ends to opposite ends of a third support member, said pair of support members converging from said third support member and integrally joined at their ends remote from said third support member.

12. The combination according to claim 1, in which said means anchored between opposed ends of said mounting rings are circumferentially arranged about a central axis coincident with the axis of said mounting rings.

13. The combination according to claim 1, in which said cathode-heater assembly comprises a cathode button having an operating temperature in the order of 750° to 1100° C. for satisfactory electron emission, and a heater filament supported is association with said cathode button in a manner to raise the cathode button to operating temperature with substantially less watts per square centimeter of cathode area than required with conventional cathodes.

14. The combination according to claim 1, in which said cathode is supported directly on said heater assembly.

15. The combination according to claim 1, in which said cathode-heater assembly includes a cathode button having an operating temperature in the order of 750° C. to 900° C. for satisfactory electron emission.

16. The combination according to claim 1, in which said cathode-heater assembly includes a cathode button having an operating temperature in the order of 900° C. to 1100° C. for satisfactory electron emission.

17. The combination according to claim 1, in which said cathode-heater assembly comprises:

(a) a circular cathode button having an electron emissive surface and a heat receiving surface;

(b) a flat wafer-like dielectric body of thermally conductive material having one surface thereof thermally conductively contiguous with the heat receiving surface of said cathode button;

(c) a pair of elongated heater filaments arranged in spaced parallelism in a common plane about a central axis to form a flat wafer-like heating element embedded in said flat wafer-like dielectric body, the ends of said filaments associated adjacent said central axis being electrically conductively interconnected and the opposite ends of said filaments being spaced about and embedded adjacent the outer periphery of said flat water-like dielectric body;

(d) said heater leads comprising first and second electrically conductive support tabs having corresponding ends embedded in said dielectric body and electrically connected to said embedded spaced opposite ends of said heater filaments and including support portions extending radially outwardly from said wafer-like dielectric body; and (e) a third support tab having one end embedded in said wafer-like dielectric body adjacent the periphery thereof and spaced from said first and second support tabs and electrically isolated therefrom and extending radially outwardly from said wafer-like dielectric body.

18. The combination according to claim 1, in which said cathode-heater assembly comprises:

(a) a circular cathode button having an electron emissive surface and a heat receiving surface;

(b) a flat wafer-like dielectric body of thermally conductive material having one surface thereof thermally conductively contiguous with the heat receiving surface of said cathode button;

(c) an electrically energizable heater element embedded in said wafer-like dielectric body and including heater leads forming a pair of electrically conductive terminal support tabs extending radially from said wafer-like dielectric body and spaced from each other and from a third support tab; and (d) a heat conductive shell enclosing said flat wafer-like body and including a peripheral edge portion thermally conductively joined to a peripheral portion of said cathode button whereby heat from the surface of said wafer-like dielectric body opposite the surface contiguous to the heat receiving surface of the cathode is conducted to said peripheral portion of said cathode button.

19. The combination according to claim 1, in which said cathode-heater assembly comprises:

(a) a cathode button having an electron emissive surface and a heat receiving surface;

(b) a flat wafer-like dielectric body of thermally conductive material having one surface thereof thermally conductively contiguous with the heat receiving surface of said cathode button;

(c) an electrically energizable heater element embedded in said wafer-like dielectric body and including a pair of heater leads forming electrically conductive terminal support tabs extending from said wafer-like dielectric body and spaced from each other and from a third support tab; and (d) a heat conductive shell enclosing said flat wafer-like body and including a peripheral edge portion thermally conductively joined to a peripheral portion of said cathode button whereby heat from the surface of said wafer-like dielectric body opposite the surface contiguous to the heat receiving surface of the cathode is conducted to said peripheral portion of said cathode button;

(e) said heat conductive shell including a bottom integral with a side wall, the open end of said shell having a radially extending flange contiguous to the heat receiving surface of said cathode button and joined thereto in thermally conductive association.

20. The combination according to claim 1, in which said cathode-heater assembly comprises:

(a) a cathode button having an electron emissive surface and a heat receiving surface;

(b) a flat wafer-like dielectric body of thermally conductive material having one surface thereof thermally conductively contiguous with the heat receiving surface of said cathode button;

(c) an electrically energizable heater element embedded in said wafer-like dielectric body and including a pair of heater leads forming electrically conductive terminal support tabs extending from said wafer-like dielectric body and spaced from each other and from a third support tab; and (d) a heat conductive shell enclosing said flat wafer-like body and including a peripheral edge portion thermally conductively joined to a peripheral portion of said cathode button whereby heat from the surface of said wafer-like dielectric body opposite the surface contiguous to the heat receiving surface of the cathode is conducted to said peripheral portion of said cathode button;

(e) said heat conductive shell including a bottom integral with a side wall, the open end of said cup-shaped shell being disposed about the periphery of said cathode button and joined thereto in thermally conductive association.

21. In combination, a cathode-heater assembly and support structure therefor, comprising:

(a) a pair of dialectric mounting rings arranged in end-to-end relation and bonded to one another;

(b) means anchored between opposed ends of said mounting rings and including a plurality of triangled support structures each having an apex end and a base end;

(c) a cathode-heater assembly fixed on the apex ends of said triangled support structures; and (d) said means anchored between opposed ends of said mounting rings including a plurality of radially outwardly extending support straps spaced circumferentially about said mounting rings, and electrically insulated from the associated triangled support structures.

22. In combination, a cathode-heater assembly and support structure therefor, comprising:

(a) a pair of dielectric mounting rings arranged in end-to-end relation and bonded to one another;

(b) means anchored between opposed ends of said mounting rings and including a plurality of triangled support structures each having an apex end and a base end; and (c) a cathode-heater assembly fixed on the apex ends of said triangled support structures;

(d) said means anchored between opposed ends of said mounting rings including a plurality of electrically conductive terminal straps spaced circumferentially about the inner periphery of said mounting rings and extending substantially perpendicular to a plane common to the ends of said mounting rings bonded end-to-end, and a plurality of radially outwardly extending support straps spaced circumferentially about the outer periphery of said mounting rings and electrically isolated from said conductive terminal straps.

23. In combination, a cathode-heater assembly and support structure therefor, comprising:

(a) a pair of dielectric mounting rings arranged in end-to-end relation and bonded to one another;

(b) means anchored between opposed ends of said mounting rings and including a plurality of triangled support structures each having an apex end and a base end; and (c) a cathode-heater assembly fixed on the apex ends of said triangled support structures;

(d) said cathode-heater assembly including a plurality of support tabs extending radially outwardly, at least two of such tabs constituting electrically conductive heater leads, said cathode-heater assembly being fixed on said triangled support structures by integral interengagement of said heater leads and at least one other support tab to the apex ends of said support structures.

24. In combination, a cathode-heater assembly and support structure therefor, comprising:

(a) a pair of dielectric mounting rings arranged in end-to-end relation and bonded to one another;

(b) means anchored between opposed ends of said mounting rings and including a plurality of triangled support structures each having an apex end and a base end; and (c) a cathode-heater assembly fixed on the apex ends of said triangled support structures;

(d) each said mounting ring comprising a toroidal dielectric body having inner and outer peripheries concentric about a central axis and connected by opposite end surfaces spaced apart to define the thickness of said mounting ring, an annular groove formed in each opposite end surface spaced between said inner and outer peripheries and disposed opposite one another, the body in the area between the annular grooves and the inner periphery being reduced in thickness whereby when said pair of mounting rings are arranged end-to-end the reduced-in-thickness-body portions lie juxtaposed with opposed surfaces axially spaced apart.

25. In combination, a cathode-heater assembly and support structure therefor, comprising:

(a) a pair of dielectric mounting rings arranged in end-to-end relation and bonded to one another;

(b) means anchored between opposed ends of said mounting rings and including a plurality of triangled support structures each having an apex end and a base end;

(c) a cathode-heater assembly fixed on the apex ends of said triangled support structures; and (d) shield means interposed between said cathode and the apex ends of said support structures.

26. In combination, a cathode-heater assembly and support structure therefor, comprising:

(a) a pair of dielectric mounting rings arranged in end-to-end relation and bonded to one another;

(b) means anchored between opposed ends of said mounting rings and including a plurality of triangled support structures each having an apex end and a base end; and (c) a cathode-heater assembly fixed on the apex ends of said triangled support structures, said cathode-heater assembly including:

(1) a cathode button having an electron emissive surface and a heat receiving surface connected by a peripheral surface;

(2) a shield ring mounted on the cathode button and having a plurality of spaced shield tabs extending beyond the peripheral surface of the cathode button above said apex ends;

(3) a thermally conductive shell secured to the cathode button and defining an enclosed chamber one side of which is closed by the heat receiving surface of said cathode button; and (4) an electrically energizable heater assembly filling said enclosed chamber and including a surface in thermally conductive contiguous association with the heat receiving surface of the cathode button and a surface in thermally conductive contiguous association with said shell.

27. The combination according to claim 1, in which means are provided surrounding said mounting rings in coaxial relation, and said cathode-heater support structure is fixed within said surrounding means.

28. The combination according to claim 1, wherein the heater portion of said cathode-heater assembly comprises:

(a) a pair of elongated heater filaments formed from an electrically resistive material and arranged in spaced spiral parellelism in a common plane about a central axis to form a flat wafer-like heater element, the ends of said filaments associated adjacent said central axis being electrically conductively interconnected and the opposite ends of said filaments being spaced about the outer periphery of said flat wafer-like heating element; and (b) said heater leads including first and second electrically conductive support tabs having corresponding ends connected to said opposite ends of said heater filaments.

29. The combination according to claim 28, in which said electrically resistive material is in the order of from 0.001″ to 0.005″ thick.

30. The combination according to claim 28, in which said electrically resistive material is a flat ribbon, the width of said spiral filaments measured in a transverse dimension being in the order of 0.001" to 0.005" wide.

31. The combination according to claim 28, in which the space between said parallel filaments is in the order of 0.001" to 0.010" wide.

32. The combination according to claim 28, in which said electrically resistive material is selected from the group of materials having an operating temperature ranging between 900° C. and 1500° C. and being equivalent to nickel-based alloys at the low end of the range and tungsten at the high end of the range.

33. The combination according to claim 1, in which said cathode-heater assembly includes a pair of elongated heater filaments fabricated from a flat sheet of suitable material and arranged in spaced spiral parallelism in a common plane about a central axis to form a flat wafer-like generally circular heating element for a thermionic emission device, the ends of said filaments associated adjacent said central axis being electrically conductively interconnected and the opposite ends of said filaments being circumferentially spaced about the outer periphery of said generally circular wafer-like heating element, and heater leads formed from the same sheet of material and integral with said opposite ends.

34. The combination according to claim 33, in which said flat sheet of material is formed of molybdenum.

35. The combination according to claim 33, in which said flat sheet of material is formed of an alloy of molydbenum and rhenium.

36. The combination according to claim 33, in which said flat sheet of material is formed of an alloy of tungsten and rhenium.

* * * * *